US006527869B1

(12) United States Patent
Bourg

(10) Patent No.: US 6,527,869 B1
(45) Date of Patent: Mar. 4, 2003

(54) METHOD FOR CLEANING DEPOSITS FROM THE INTERIOR OF PIPES

(76) Inventor: Christopher J. Bourg, 1037 Harrison St., Thibodaux, LA (US) 70301

( * ) Notice: Subject to any disclaimer, the term of this patent is extended or adjusted under 35 U.S.C. 154(b) by 0 days.

(21) Appl. No.: 09/590,430

(22) Filed: Jun. 8, 2000

(51) Int. Cl.[7] ..... B08B 3/02
(52) U.S. Cl. ..... 134/1; 134/2.11; 134/22.12; 134/8; 15/3.5; 15/104.062
(58) Field of Search ..... 134/8, 22.11, 22.12, 134/1; 15/104.061, 104.062, 3.5, 1

(56) References Cited

U.S. PATENT DOCUMENTS

| | | | | |
|---|---|---|---|---|
| 3,600,736 | A | * | 8/1971 | Smith et al. |
| 3,643,280 | A | * | 2/1972 | Powers |
| 3,732,434 | A | | 5/1973 | French |
| 4,475,255 | A | | 10/1984 | Tash |
| 4,498,932 | A | | 2/1985 | Kruka |
| 4,724,007 | A | * | 2/1988 | Barry et al. |
| 4,860,821 | A | * | 8/1989 | Hagewood ..... 165/95 |
| 5,186,757 | A | * | 2/1993 | Abney, Sr. ..... 134/8 |
| 5,423,917 | A | | 6/1995 | Garcia, Jr. |
| 5,442,826 | A | * | 8/1995 | Murata et al. |
| 5,444,887 | A | | 8/1995 | Rufolo |
| 5,640,734 | A | * | 6/1997 | Kuwashima |
| 5,674,323 | A | | 10/1997 | Garcia |
| 5,795,402 | A | | 8/1998 | Hargett, Sr. et al. |
| 5,875,803 | A | | 3/1999 | Leitko et al. |
| 6,014,789 | A | | 1/2000 | Knapp |
| 6,176,938 | B1 | * | 1/2001 | Palmer |

OTHER PUBLICATIONS

Brochure; Rotary Waterblast Cleaning Head, Model RJV, Operation & Maintenance Manual; Oct., 1998; StoneAge Waterjet Engineering. 54 Girard St., Durango, Colorado 81301; 1 page.

Brochure; Typical SpanJet Installations; 1997; 2000 NLB Corp., Wixom, MI, USA; 1 page.

Brochure; Girard Polyurethane Cups and Discs; Girard Industries, 6531 N. Eldridge Parkway, Houston, Texas 77041–3507; 1 page.

Brochure; Steel Mandrel Pigs; Girard Industries, 6531 N. Eldridge Parkway, Houston, Texas 77041–3507; 4 pages.

Brochure; "The Art of Pigging"; Girard Industries, 6531 N. Eldridge Parkway, Houston, Texas 77041–3507; 6 pages.

Brochure; Euro Aqua Drill, Inc; 1997; 1300 FM 646 East, Dickinson, Texas 77539; 1 page.

Brochure; Hydroblasting Services; Plant Maintenance Services, 11308 State Route 143, Highland, Illinois 62249; 2 pages.

Rochure; Rigid Tube Lancing Systems; StoneAge WaterJet Tools, 54 Girard Street, Durango, Colorado 81301; 2 pages.

Brochure; Statement of Qualifications; 1998; AIMM Technologies, Inc., 405 Ross Street; La Marque, Texas 77568; title page, page 1 and pp. 3–19.

Bochure; Hydrokinetic Cleaning Solution to Process Problems; 1998; AIMM Technologies, Inc., 405 Ross Street; La Marque, Texas 77588, USA; 2 pages.

* cited by examiner

*Primary Examiner*—Frankie L. Stinson
(74) *Attorney, Agent, or Firm*—E. Eugene Thigpen

(57) ABSTRACT

In a first embodiment the invention comprises a method for cleaning deposits from the interior of a pipe in which a pig is propelled through the pipe by pressure from a fluid mixture of at least one liquid and at least one gas applied to the pig from the rear end of the pig. A portion of the fluid mixture is conducted from the rear of the pig to at least one nozzle on the forward end of said pig and propelled through the nozzle to clean the deposits from the interior of said pipe.

8 Claims, 7 Drawing Sheets

METHOD FOR CLEANING DEPOSITS FROM THE INTERIOR OF PIPES

BACKGROUND OF THE INVENTION

1. Field of the Invention

The present invention relates to a system for cleaning the interior of pipes. In particular, the invention comprises a system for cleaning deposits from the walls of pipelines or other pipe systems.

2. Background

Pipeline systems are utilized throughout the world to transport petroleum products, water, municipal wastes, chemical slurries and other fluids. During the transport of these materials there is often a build-up of materials, including paraffin, calcium and silica, on the inner wall of the pipeline. One of the materials which builds up most frequently in petroleum pipelines is paraffin. As the deposits of paraffin and/or other materials increase, the bore of the pipeline or other piping through which the fluid flows becomes restricted, resulting in a loss of fluid flow. or an increase in energy required to maintain the fluid flow.

Pipeline pigs have been used for many years to remove deposits from the inside of pipes. A pipeline pig comprises a body having an outer circumference closely matching the inner circumference of the pipe. The pig is inserted in the pipe and is forced through the pipe by fluid pressure. As the pig travels through the pipe it scrapes the deposits from the interior wall of the pipe and transports these deposits along the pipeline. The pig needs to be substantially rigid in order to scrape deposits form the wall of the pipe, but the pig also needs to be somewhat compressible in order to pass by restrictions in the internal pipe cross-section or obstructions that may be present in the pipe. Typically the exterior surface of a pipeline pig is formed from a plastic material, such as polyurethane. A disadvantage of these pigs is that the build-up of paraffin or other material inside the pipe may be so rigid that the pig will compress and ride over the build-up, which results in insufficient cleaning. Normally, the fluid pressure for propelling the pig through the pipe is supplied by water or other liquids which are injected into the pipe at high pressure following insertion of the pig into the pipe. It is also known to the prior art to initially inject high pressure water behind the pig and to then discontinue the injection of water and inject only a gas to complete the propulsion of the pig through the pipe.

Fluids have been used in conjunction with pipeline pigs for certain cleaning purposes. U.S. Pat. No. 5,795,402, which issued on Aug. 18, 1998 to Hargett, Sr. et al., discloses a pipeline pig having a plurality of nozzles positioned on the forward end of the pig for allowing fluid under pressure to flow from the nozzles onto the inner wall of the pipeline. When the pig encounters an obstruction which hinders forward movement, pressure is increased sufficiently to move a valving member to the open position which allows fluid under pressure to spray from the nozzles to provide sufficient heating to melt the paraffin or other build-up. In one embodiment of the system disclosed in U.S. Pat. No. 5,795,402, a first chemical compound, preferably hydrochloric acid, is positioned forward of the pig, and a second chemical compound, preferably anhydrous ammonia, is positioned to the rear of the pig. When an obstruction is encountered, fluid in a chamber 36 reaches a certain pressure and a sealing member 74 within a pressure valve 70 moves forward, allowing fluid to flow into the nose cone of the pig and out the nozzles. Upon this happening, the anhydrous ammonia encountering the hydraulic acid will create an exothermic reaction and the resulting heat will melt the built up paraffin. When the paraffin has been sufficiently softened the pig is then able to move forward under pressure applied to the rear of the pig. In another embodiment disclosed in U.S. Pat. No. 5,795,402, the water which is used to push the pig is heated to a very high temperature, above the temperature for melting paraffin. When the pig reaches an obstruction of paraffin, valve member 70 is activated, which allows the super heated water to flow into the nose cone of the pig and out of the nozzles under pressure to begin melting or softening the wax build-up. As the pig moves forward, pressure is reduced and the valve 70 closes, and the pressure of the water simply moves the pig along the pipeline until it encounters another obstruction.

U.S. Pat. No. 4,498,932, which issued on Feb. 12, 1985 to Kruka, discloses a pipeline pig having a restricted fluid bypass channel which serves to bring fluid from the back of the pig to its front. This fluid agitates and suspends discrete solids such as sand or rust, or commingles with paraffinic and asphaltic deposits which have been scraped from the pipe wall by the pig as it moves through the line, to prevent the buildup of a solid bed or plug of sufficient thickness or viscosity in front of the pig so as to cause the pig to partially collapse and ride over it or to become stuck. The passageway through the pig is terminated by nozzles or orifices which are fastened to the pig. The orifices are chosen to give a desired flow rate and pressure drop across the pig. In this disclosure, fluid flow through the nozzle is intended to agitate and suspend discrete solids such as sand or rust, or to commingle with scraped paraffinic and asphaltic deposits which have been scraped from the pipe walls by the pig. There is no suggestion, however, of blasting the paraffinic or asphaltic deposits from the pipeline wall with the force of the fluid stream emanating from the nozzles.

U.S. Pat. No. 5,875,803, which issued on Mar. 2, 1999 to Leitko et al., shows a conduit cleaning pig which includes a sealing means for preventing a significant flow of fluids from the upstream side of the pig to the downstream side of the pig between the conduit and the pig. The pig includes a rotating element connected to the downstream side of the seal means and a plurality of nozzles connected to the rotating element, each nozzle defining a flow path. The flowpath through the nozzles is in communication with a channel from the upstream side of the seal. The flowpaths through the nozzles are aligned in part tangentially to the cylinder around the central axis of the pig and aligned in part toward the inside wall of the conduit. Liquid jets of the fluid transporting the pig down the conduit impinge on the conduit in front of the pig and remove deposits from the wall of the conduit. The fluid passing through the pig then transports the solids through the conduit ahead of the pig.

Another system which utilizes a fluid flow to assist in cleaning the inside of a pipe is disclosed in U.S. Pat. No. 5,444,887, which issued on Aug. 29, 1995 to Rufolo. This patent discloses a cleaning device for removing shellfish obstructions from an interior surface of an underwater intake pipe. The system includes a member having a blade-like front surface and a blade-like rear surface for scraping foreign matter from the inside surface of a conduit. The cleaning device also includes fluid jet nozzles for producing a jet stream used in transferring the foreign matter along the pipe's floor. While the system uses a fluid stream to transfer foreign matter scraped from the pipe wall by the blades, there is no suggestion of using the fluid stream to blast the foreign matter from the pipe walls.

Hydro blasting is another method which has been utilized to clean the inside of pipes. The hydro blasting process for cleaning the interior of a pipe typically employs a line mole attached to the end of a hose, which is inserted into the pipe, such as the system illustrated in a brochure from Euro Aqua Drill, of Webster, Tex. High pressure water is supplied to the line mole through the hose, which will extend to the line mole from a high pressure water pump on the exterior of the pipe. The line mole includes nozzles through which water is ejected at a high velocity as the line mole travels through the pipe. Some of these nozzles face in a diagonally forward direction or perpendicular direction with respect to the axis of the pipe, and the water which is ejected through these nozzles blasts the paraffin or other deposit from the pipe wall. Other nozzles face in the reverse or diagonally reverse direction, and sufficient water or other fluid is propelled in the reverse direction to create a jet propulsion to propel the line mole, along with the attached hose, into the pipe. A hose is unreeled from a rotating device operated by an air motor driven by an air compressor. As the line mole travels into the pipe, it will have to drag a greater and greater length of the hose, and a correspondingly greater and greater weight, and the distance the line mole can travel into the pipe is limited. Accordingly, the length of pipe that can be cleaned with this process is limited.

A "hydrokinetic" process for cleaning relatively short pipes is presented in a brochure from AIMM Technologies, Inc. This process is said to be based on resonant frequency—the process of inducing a frequency vibration into the water stream. The brochure states that: "An oscillating water stream is transmitted into the tubc or pipe which is to be cleaned. The resonance is then transferred to both the tube and to the fouling material, which will vibrate at different frequencies because they are of different densities. The separate vibrations cause a break in the cohesion between the fouling material and the tube wall and fouling material flushes from the pipe via the water stream." The hydrokinetic method is implemented by injecting into the pipe entrance an oscillating water stream interspersed with air. Because the fluids are injected into the pipe at the pipe entrance the length of pipe than can be cleaned with this process is limited.

A long felt need remains, however, for a more efficient system for cleaning the inside of pipelines and other piping systems; a need that is met by the invention disclosed herein.

SUMMARY OF THE INVENTION

In a first embodiment the invention comprises a method for cleaning deposits from the interior of a pipe in which a pig is propelled through the pipe by pressure from a fluid mixture of at least one liquid and at least one gas applied to the pig from the rear end of the pig. A portion of the fluid mixture is conducted from the rear of the pig to at least one nozzle on the forward end of said pig and is propelled through the nozzle to clean the deposits from the interior of the pipe. In a particular implementation, the fluid mixture cleans the interior of said pipe simultaneously by blasting and by the generation of vibrations of different frequencies in the pipe and in the deposits.

In another embodiment the invention comprises a method of determining a maximum pressure that may be safely used for cleaning the interior of a pipe. The wall thickness of the pipe, the yield point of the pipe material in new condition, the number of months the pipe has been in use, and the outside diameter of the pipe are determined and the following relationship, (2t)(myp)/0.75(o.d.), is utilized to determine such maximum pressure, wherein t is equal to the pipe wall thickness, myp is equal to the yield point of the pipe material in new condition reduced by 0.1 percent per month for each month the pipe has been in use, and o.d. is equal to the outside diameter of the pipe.

In yet another embodiment the invention comprises a pig for cleaning the inside of a pipe. The pig includes a flexible fluid conduit having a rear end and a forward end, a first cylindrical member having a surface against which fluid pressure may be applied to propel the pig through the pipe mounted on the conduit at substantially the rear end of the conduit and a second cylindrical member having a surface adapted to form a substantially sealing engagement with the interior wall of the pipe mounted on the conduit at substantially the forward end of the conduit. A plurality of nozzles are mounted in fluid communication with the fluid conduit substantially at the forward end of the conduit through which fluid flowing from the rear end of the conduit may be propelled against the pipe surface for cleaning the pipe.

BRIEF DESCRIPTION OF THE DRAWINGS

The invention and its advantages will be more easily understood by reference to the following description and the attached drawings in which.

While the invention will be described in connection with its preferred embodiments, it will be understood that the invention is not limited thereto, but shall include all alternatives, modifications, and equivalents within the scope of the appended claims.

DESCRIPTION OF PREFERRED EMBODIMENTS

Figure 1:
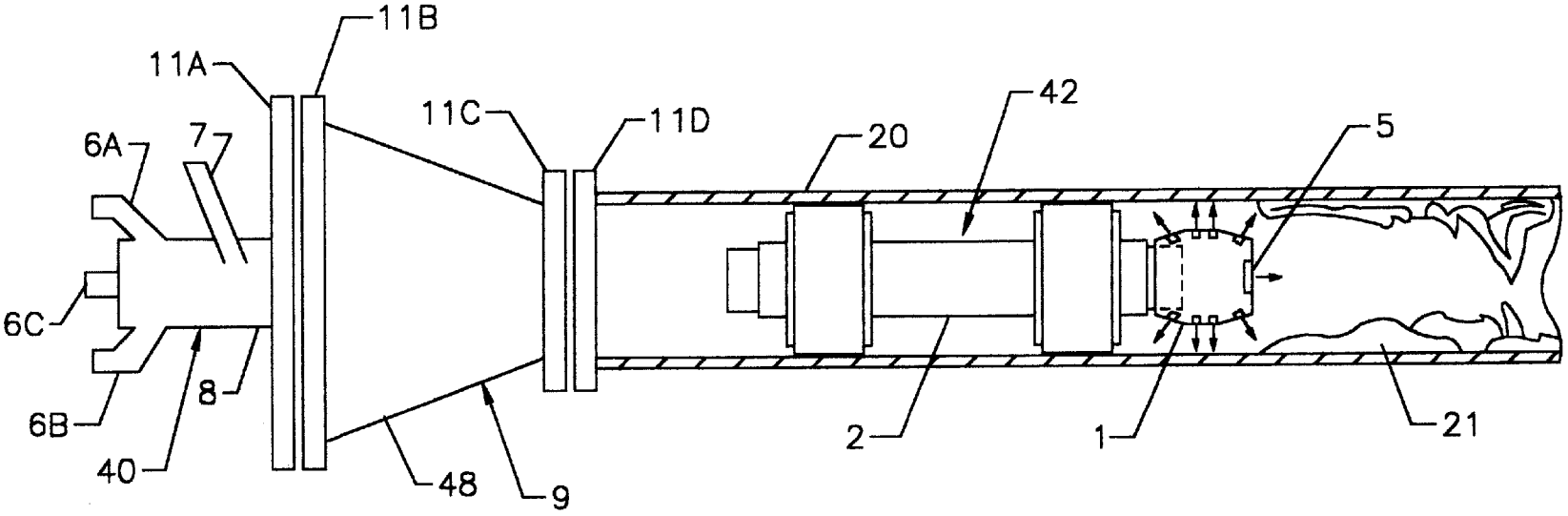
FIG. 1 shows a first implementation of the invention.

FIG. 1 shows a first implementation of the invention, in which a pig 42 is propelled through a pipe 20 for the purpose of cleaning deposits 21 from the interior wall of the pipe. The pig is propelled through the pipe by means of fluid pressure applied to the rear of the pig. The fluid pressure is generated by means of launcher 40, which is coupled to the pipe 20 through adapter 9. In the embodiment shown in FIG. 1, launcher 40 includes inlet pipes 6A, 6B and 6C, through which water is injected into the main body 8 of the launcher, and inlet pipe 7, through which air is injected into the main body 8 of the launcher.

As fluid flows into the pipe 20 from launcher 40, the pig 42 is propelled further into the pipe. A high pressure hose 2 forms a conduit extending through pig 42, and a portion of the fluid flowing into the pipe will flow into and through this high pressure hose to the forward end of the pig. A nozzle head 1 is connected to the high pressure conduit 2 at the forward end of the pig. This nozzle head includes a plurality of openings, or nozzles 5 (shown in more detail in FIGS. 3 and 5), through which the fluid flowing through high pressure conduit 2 is propelled to clean the deposits 21, which may be paraffin or other built-up material, from the pipe wall. In the preferred embodiments described herein, the fluid which is used for propelling the pig within the pipe and for cleaning deposits from the wall of the pipe is a mixture of a liquid and a gas, which may be water and air. It is understood, however, that other gases, including nitrogen and steam, and other liquids, including hydrochloric acid, citric acid, oils, diesel, soda ash and sodium nitrate could be utilized. Adding a gas to the fluid stream can accelerate the flow of the gas-liquid mixture to a velocity of approximately Mach 2 (about 2100 feet per second), which far exceeds the velocity of a high pressure liquid alone. The use of high pressure liquid, without the addition of the gas, also results in a substantial pressure drop across the nozzles, whereas the use of a gas-liquid mixture results in a substantially reduced pressure drop across the nozzles. Accordingly, the mixture of gas and liquid generates a more intense blasting jet from the nozzles 5. Adding gas to the fluid stream also substantially increases the velocity with which the pig may be propelled through the pipe. Adding a gas to the fluid stream which is injected into the pipe also reduces the amount of liquid required to propel the pig along the pipeline, which alleviates disposal problems.

The addition of gas to the fluid injected into the pipe significantly facilitates the cleaning of the pipe because of the introduction of a second cleaning mode. When a high pressure liquid (which may be water) and a gas (which may be air) arc injected into the pipe together at a high velocity, a sonic vibration in generated, which induces vibrations in the pipe 20 and the accumulated deposits 21 within the pipe. Because materials having different densities will vibrate at different pitches (frequencies) the pipe and the accumulated deposits in the pipe will vibrate at different frequencies in response to this sonic vibration, and the deposits will separate from the pipe surface. Accordingly, two different cleaning modes will operate simultaneously to clean the interior walls of the pipe of the accumulated deposits. The first mode may be referred to as hydro blasting, in which the deposits arc blasted from the interior pipe wall by the impact of the fluid which is propelled through the nozzles 5. The second mode is the separation of the accumulated deposits from the interior pipe wall resulting from the vibrations of the pipe and the accumulated deposits at different frequencies. In a preferred embodiment of the invention, water is injected into the pipe to be cleaned at a pressure of at least 1000 pounds per square inch (psi). Although some cleaning will occur at a lower pressure, a water pressure of 1000 psi or greater will achieve more effective sonic vibration cleaning.

As shown in FIG. 1, pig launcher 40 comprises a main body 8, three water inlet pipes 6A, 6B and 6C, one air inlet pipe 7, and a flange 11A. Main body 8 may be a substantially cylindrical conduit, the left end (as depicted in FIG. 1) of which is closed so that the liquid and gas entering through inlet pipes 6A, 6B, 6C, and 7 will be propelled through adapter 9 into the pipe to be cleaned. Each of pipes 6A, 6B, 6C and 7 may be one inch (2.54 cm.) outside diameter pipes. Three inlet water pipes are utilized in a preferred embodiment, because of the limited volume flow capacity of one inch pipe. As shown in FIG. 1, the right end of main body 8 is welded to a flange 11A, which is utilized for connecting the launcher 40 to adapter 9.

Figure 2:
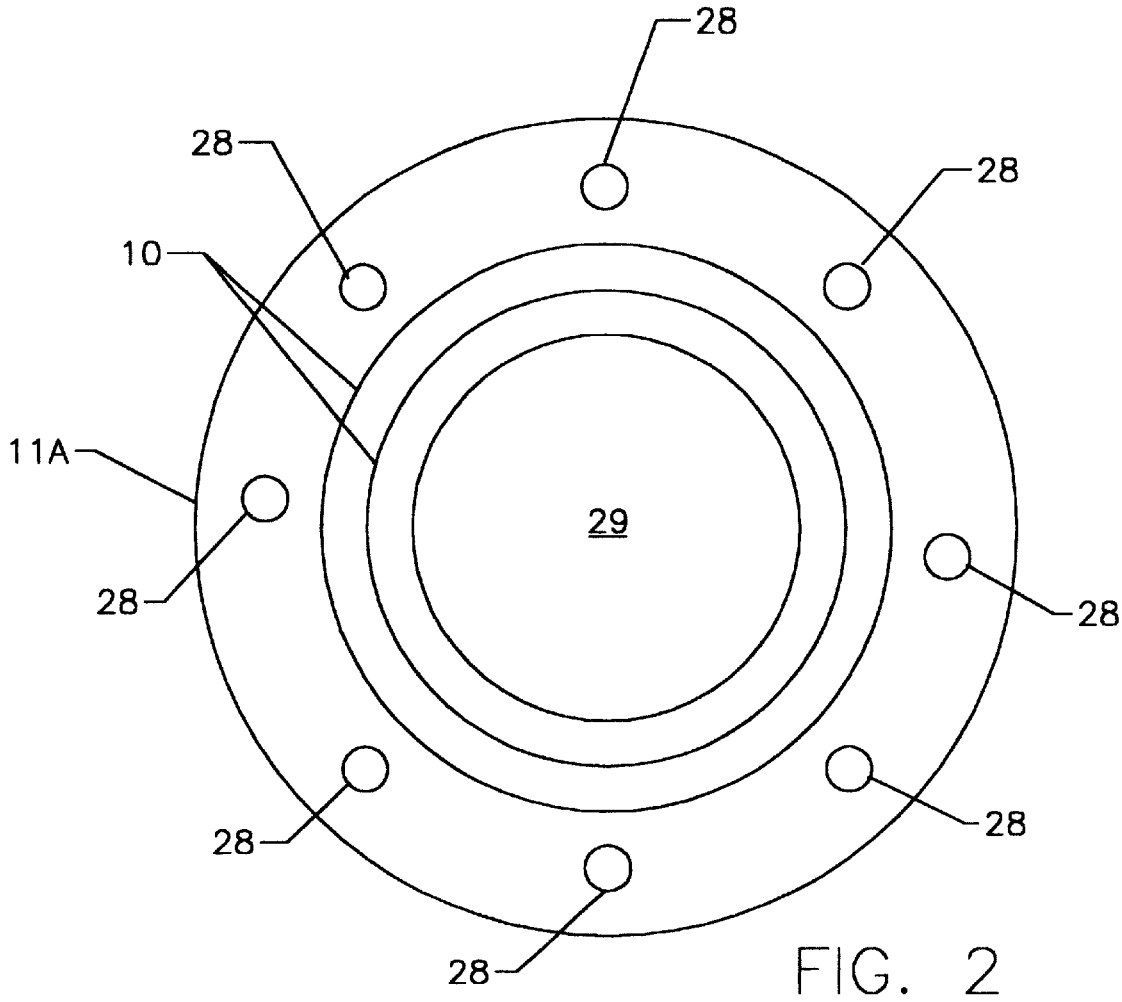
FIG. 2 shows a detail of the pig launcher.

The function of adapter 9 is to adapt the dimensions of the fluid outlet of the pig launcher 40 to the dimension of the inlet of the pipe to be cleaned. Accordingly, adapter 9 may be referred to as either a reducer or an enlarger depending on whether the pipe inlet is smaller than or larger than the launcher outlet. In the embodiment shown in FIG. 1, adapter 9 includes a first flange 11B, a second flange 11C and a frusto-conical section 48 extending between flanges 11B and 11C. Flanges 11B and 11C may each be connected to the frusto-conical section 48 by welding. In a particular embodiment, pig launcher 40 is secured to adapter 9 by bolting flange 11A to flange 11B. (The bolts are not shown.) The mating end of flange 11A is shown in FIG. 2. O-ring seals 10 are positioned in circular grooves which are milled into mating locations on the surfaces of flanges 11A and 11B. These O-rings form a fluid seal when flange 11A is bolted to flange 11B. Also shown in FIG. 2 are the apertures 28 through which flange 11A is bolted to flange 11B, and the fluid conduit 29 through which fluid flows from the launcher 40 into adapter 9. Flange 11C is connected to the end of a corresponding flange 11D on the end of pipe 20. The diameter of flange 11C is selected so that flange 11C may be bolted to flange 11D. (The bolts are not shown.) Accordingly, Flange 11C is bolted to flange 11D to secure pig launcher 40 to the pipe 20 by means of adapter 9. Matching circular grooves are also milled into flanges 11C and 11D, and O-ring seals are utilized to provide a fluid seal in the same manner as for flanges 11A and 11B. The components of pig launcher 40 and adapter 9 (i.e., main body 8, inlet pipes 6A, 6 and 6C, inlet pipe 7, flanges 11A, 11B, 11C and frusto-conical section 48) may be made from stainless steel or other material having suitable qualities of strength and ruggedness.

Figure 3:
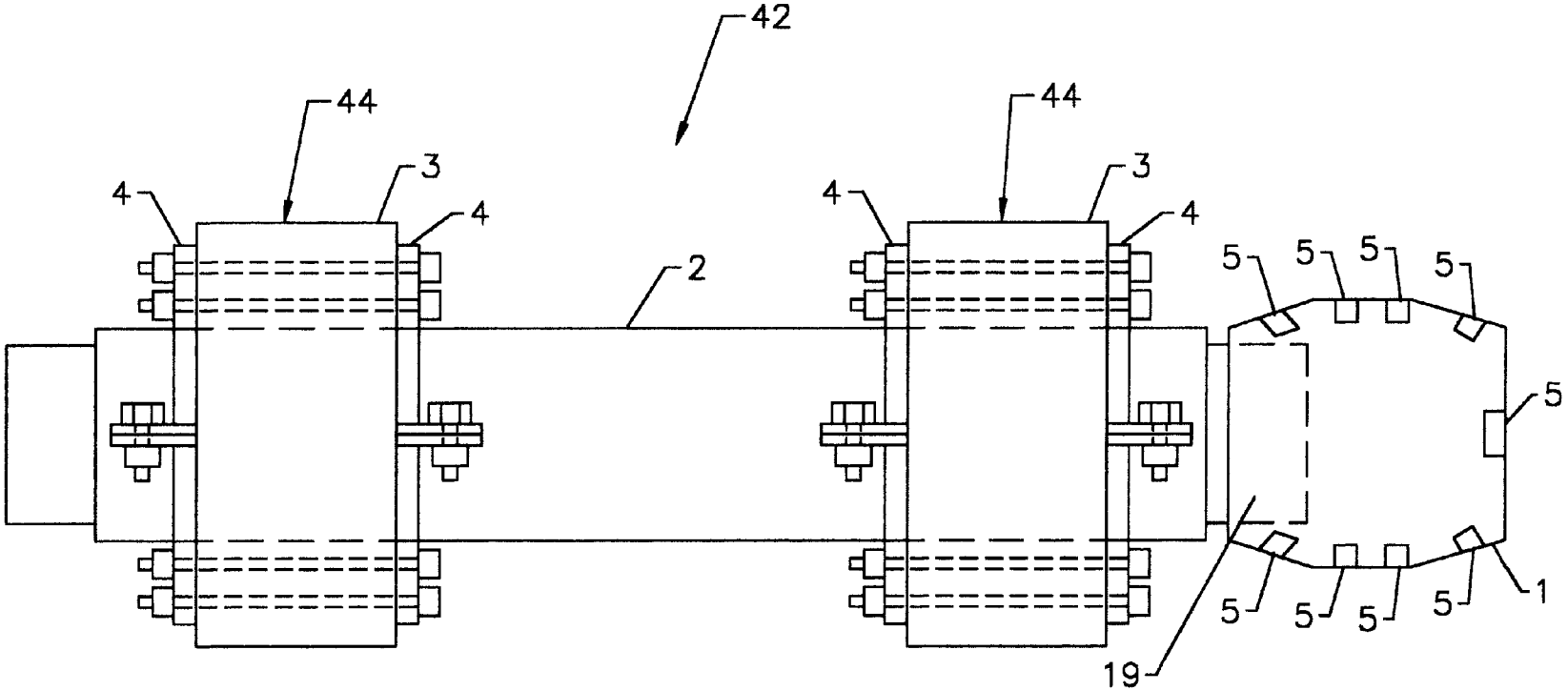
FIG. 3 a pipeline pig which is useful for practicing the invention.

A particular embodiment of pig 42, which includes two substantially similar pig elements 44, is shown in more detail in FIG. 3. In FIG. 3, corresponding subelements of pig elements 44 are designated with the same reference numerals. A high pressure conduit 2 extends through pig 42, and is connected in threaded engagement at location 19 at the forward end of pig 42 to nozzle head 1. In a particular implementation of the invention high pressure conduit 2 may be a commercially available hose made from stainless steel wires with a rubber wrapping having sufficient flexibility to enable the pig to navigate sharp corners in the pipe and sufficient compressional and tensile strength to provide structural support to the pig. The hose may be about two feet in length, with a one inch (2.54 cm.) outside diameter. Each pig element 44 includes a subelement 3 which is circumferentially mounted on high pressure hose 2. In a particular implementation of the invention, pig subelements 3 have the shape of a short cylinder, and have an outside circumference selected to be substantially equal to the inside circumference of the pipe to be cleaned. Pig subelements 3 may be made from polyurethane foam or a material having similar qualities. The material needs to have sufficient rigidity to form a substantially sealing engagement with the interior pipe surface, and to propel forward within the pipe the deposits blasted from the inside of the pipe, but enough flexibility to allow enough deformation for the pig subelements 3 to pass small irregularities in the pipe. It is also desirable if the material is substantially inert to corrosive materials typically found in the pipe to be cleaned. Typically, pig subelements 3 will have an axial length of between two inches and six inches. Construction of the pig with two separate pig elements 44, secured to flexible high pressure hose 2, enables the pig to navigate sharp corners in the pipe more easily than would be the case if the pig were formed from a single longer element. It is understood, however, that the pig could be constructed with a single pig element 44.

Figure 4A:
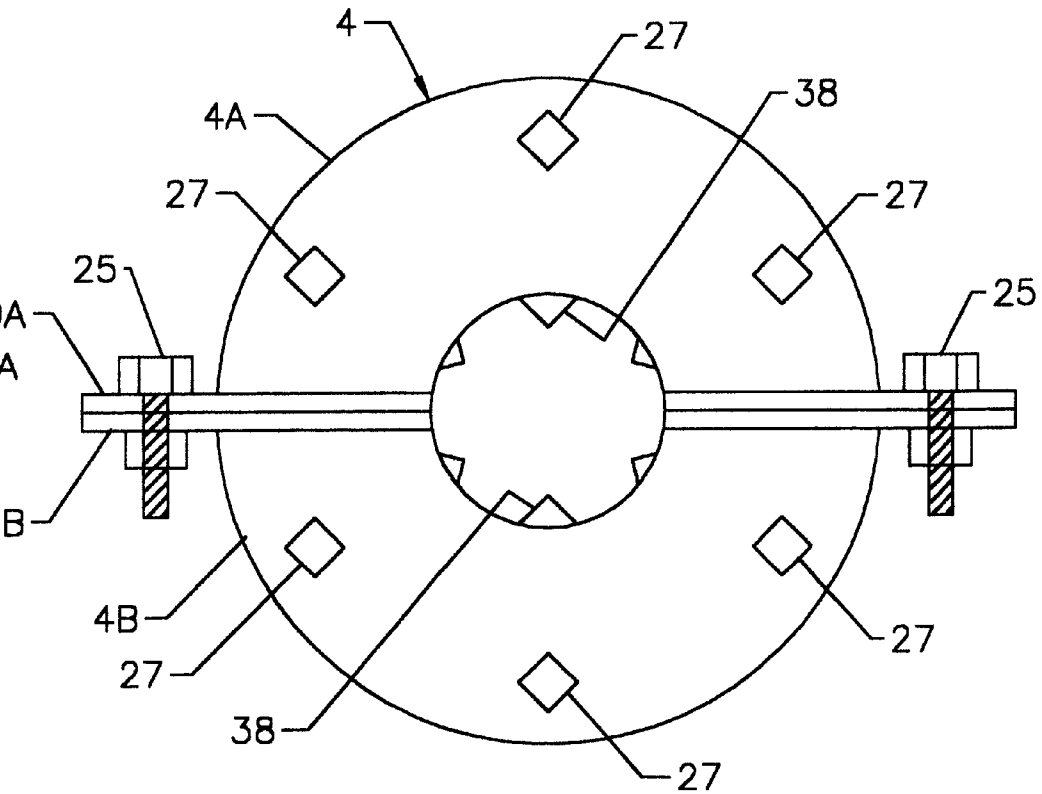
FIG. 4A and FIG. 4B show backing plates for connecting the cylindrical pig subelements to the high pressure hose extending through the pig.
Figure 4B:
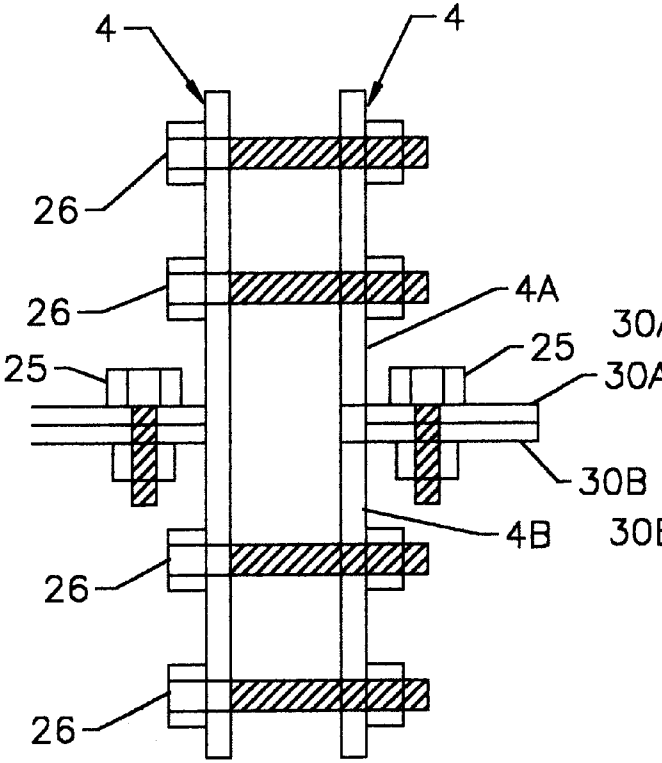

With reference to FIGS. 3, 4A and 4B, pig cylindrical elements 3 are secured on the high pressure hose by backing plates 4, which may be formed from aluminum. FIG. 4B shows a side view of backing plates 4. As shown in FIG. 4B, backing plates 4 are secured in position on either side of the pig elements 3 by bolt and nut assemblies 26. Although not shown in FIG. 4B, for clarity, a cylindrical subelement 3 (as shown in FIG. 3) is positioned between the two backing plates 4 when assembled, and the bolts, of bolt and nut assembles 26, extend through apertures 27 in the backing plates 4 and through apertures (not shown) in corresponding positions in cylindrical subelements 3. The backing plates 4 include gripping teeth 38, which extend inwardly from the inside diameter of backing plates 4 to anchor the backing plates to the high pressure hose 2. As shown, a backing plate 4 comprises two hemispherical elements 4A and 4B, which are assembled around the high pressure hose 2 by bolt and nut assemblies 25 to form the backing plate. The two hemispherical elements 4A and 4B of a backing plates 4 include lateral extensions 30A and 30B, respectively, which may be welded to hemispherical elements 4A and 4B in the configuration shown. These lateral extensions 30A and 30B include apertures through which the bolts, of bolt and nut assemblies 25, are inserted for clamping the two hemispherical elements together. Bolt and nut assemblies 25 secure the two hemispherical elements 4A and 4B into the backing plate configuration. in a compressional position around the high pressure hose 2, such that gripping teeth 38 securely grip the hose 2 and prevent the pig subelements 3 from sliding along the high pressure hose 2 as the hose is propelled through the pipe to be cleaned.

Figure 5:
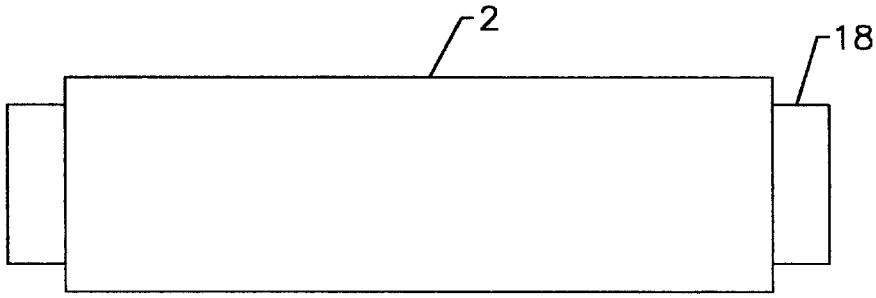
FIG. 5 shows a high pressure hose useful in practicing the invention.
Figure 6:
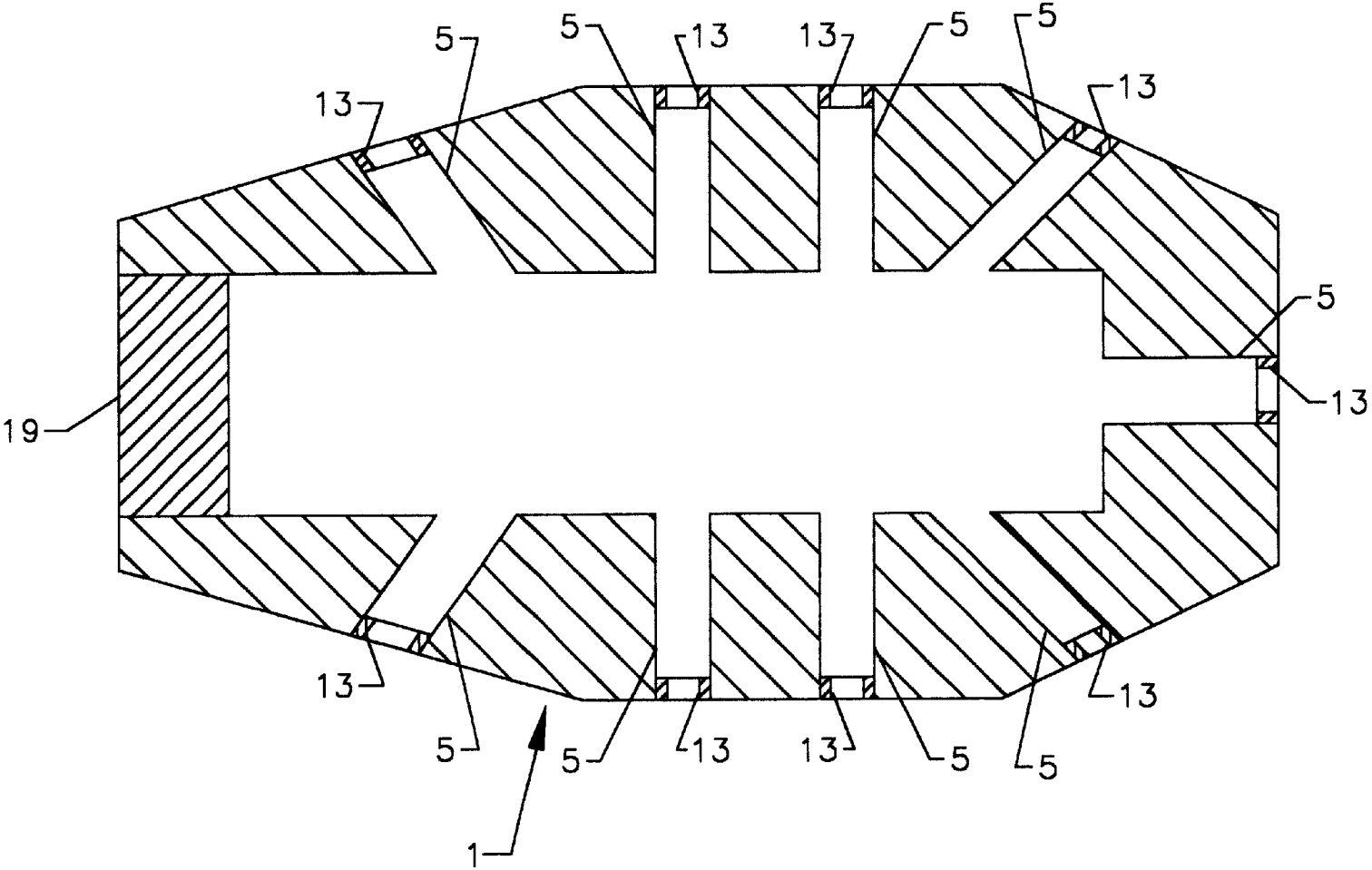
FIG. 6 shows a nozzle head for use in practicing the invention.

As shown in FIG. 5, high pressure hose 2 includes a threaded end 18 (which may be a one inch, NPT threaded end) at at least the forward end thereof. With reference to FIG. 6, the threaded end of high pressure hose 2 extending to the forward end of the pig is connected in threaded engagement with nozzle head 1 at location 19. Nozzle head 1, may be a standard hydro blasting nozzle formed from stainless steel or other material having similar qualities. The nozzle head normally includes a plurality of nozzles 5. The fluid flow is through high pressure hose 2 into the nozzle head 1, and then out through the nozzle holes 5. Typically, inserts 13 are positioned in threaded engagement in the outlet side of each nozzle. Use of theses inserts allows the nozzle apertures to be conveniently changed in order to vary the fluid flow through the nozzles. The inserts 13 are typically selected so that the nozzle head will flow between 10 and 150 gallons of water per minute. Typically, about half of the water injected into the pipe being cleaned will flow through the nozzle head, and half of the water will be used to maintain pressure and propel the pig through the pipe. Some of the nozzles 5 will typically be directed diagonally rearward so that reverse jets can break up material that get between the nozzle head and pig element 44. The reverse jets also assist in propelling the pig forward in the pipe.

In performing the present invention, the pig 42 is inserted into the pipe 20 as shown in FIG. 1. The pig launcher 40 is then attached to the pipe by means of adapter 9. An air source is attached to inlet air pipe 7, and a water source is attached to inlet water pipes 6A, 6B and 6C. Fluid pressure from the air-water fluid mixture is then applied to the rear, or propulsion side, of the pig 42. A portion of the fluid will enter high pressure hose 2, and will be propelled through hose 2 and out of the nozzle holes 5 in nozzle head 1. The portion of the fluid which does not enter hose 2 will apply a force to the rear end of pig element 44, forcing the pig through the pipe to be cleaned.

Figure 7:
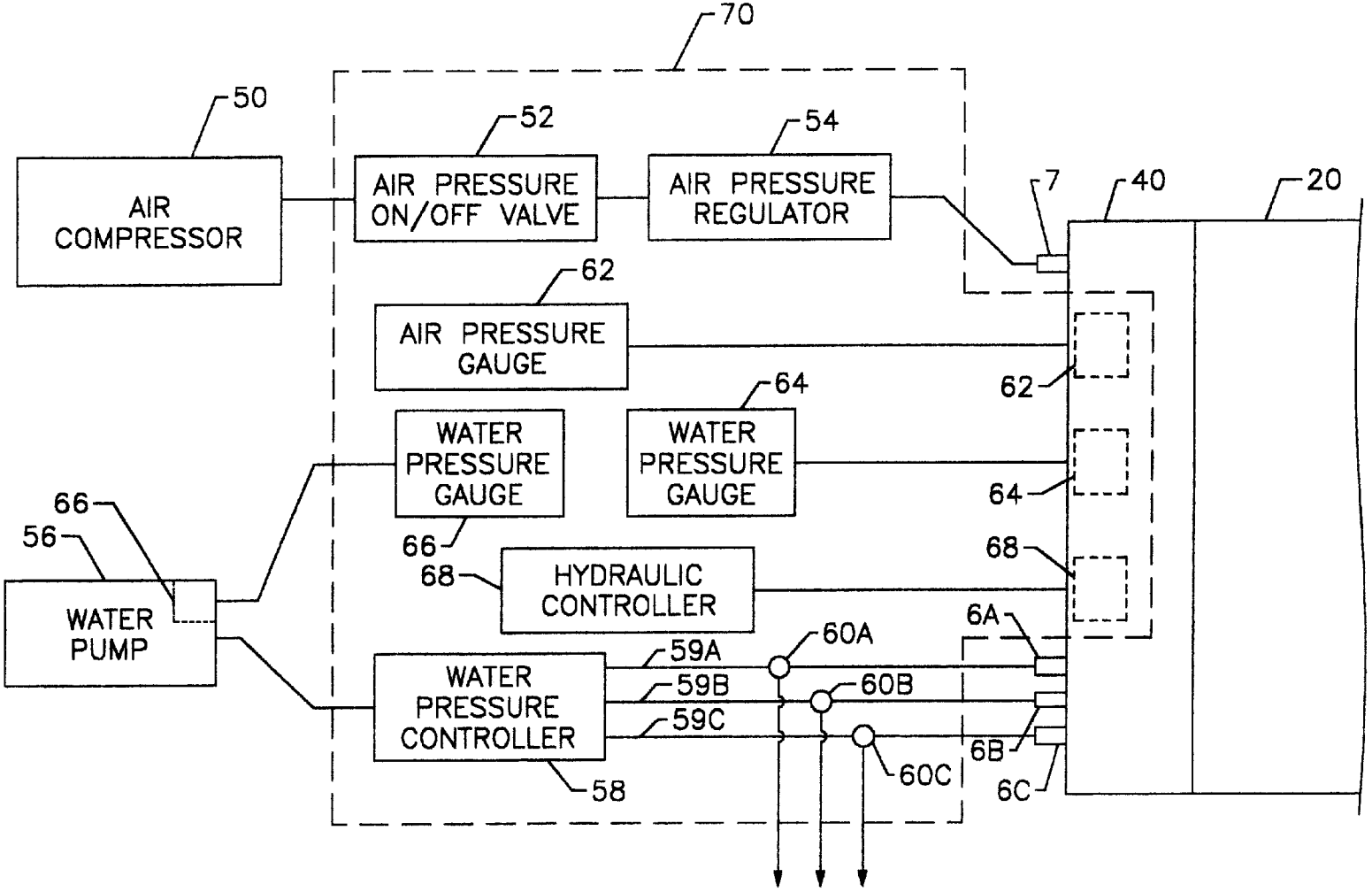
FIG. 7 shows a schematic diagram of a control system for a preferred embodiment of the invention.

FIG. 7 shows a schematic diagram of a control system 70 for a preferred embodiment of the invention. Although it is understood that a liquid other than water and a gas other than air could be utilized to practice the invention, a preferred embodiment of the invention will be described with reference to the use of water and air. As shown in FIG. 7, water pump 56 supplies water under pressure. The water flows from pump 56 through water pressure controller 58, which is utilized to adjust the pressure of the water entering pig launcher 40. As the water leaves the water pressure controller 58 it flows through three separate conduits 59A, 59B and 59C, and three separate water pressure relief valves, 60A, 60B and 60C, and into inlet water pipes 6A, 6B and 6C, respectively, on the pig launcher 40. The water pressure relief valves may be three-way fittings, which may be utilized to divert the water flow onto the ground, rather than into the pipe to be cleaned. Air flows from air compressor 50 through air pressure on/off valve 52 and air pressure regulator 54, and into the inlet air pipe 7 on the pig launcher. Water pressure gauge 64 and air pressure gauge 62 monitor the water pressure and the air pressure at the pig launcher water and air inlets. Water pressure gauge 66 monitors the water pressure at the water pump 56. Hydraulic controller 68 allows the operator to control the pressure of the water/air mixture in the pipeline. In a preferred implementation of the invention a control panel (not shown) would include operator control knobs for the water pressure controller 58, water pressure relief valves 60A, 60B and 60C, air pressure on/off valve 52, air pressure regulator 54 and hydraulic controller 68. The control panel would also include displays for water pressure gauges 64 and 66 and air pressure gauge 62. As shown in FIG. 7, pump 56, which may be a 10,000 psi pump, capable of pumping 0 to 600 gallons per minute, and air compressor 50, which may be a 900 cubic feet per minute air compressor, may be utilized to supply water and air, respectively, to water inlet pipes 6A, 6B and 6C, and air inlet pipe 7. Typically, for up to 5000 psi of water pressure, 100 psi of air pressure will be employed. For a water pressure of between 5000 and 7000 psi, 125 psi of air pressure will be used, and for 7000 to 10,000 psi of water pressure, 150 psi of air pressure will be used.

The higher the pressure with which the fluid is propelled through the nozzles 5, the more effective will be the cleaning of deposits from the interior pipe wall. However, if the pressure in the pipe exceeds the pressure which the pipe can safely tolerate (the burst pressure), the pipe can rupture. The traditional formula, known to those of ordinary skill in the art as Barlow's Formula, for determining the pipe burst pressure is as follows:

$$(2t)(ts)/(o.d.=\text{burst pressure} \qquad \text{Eq. 1}$$

where:

t=pipe wall thickness, ts=tensile strength of the pipe, and o.d.=outside diameter of the pipe.

However, as a pipe ages, the ability of the pipe to withstand pressure diminishes because of deterioration from oxidation and other reasons. I have determined from empirical observations that the following formula, a modification of Barlow's Formula, may be utilized to determine the maximum working pressure that may safely be applied for cleaning the interior surface of a pipe:

$$(2t)(myp)/0.75(o.d.)=\text{maximum working pressure} \qquad \text{Eq. 2}$$

where:

t=pipe wall thickness, myp=age adjusted material yield point of the pipe, and o.d.=outside diameter of the pipe.

To determine the age adjusted material yield point, the material yield point for the pipe material, when in new condition, is first determined from published sources, such as the American Society of Mechanical Engineers Code Book, and this published material yield point is reduced by one-tenth of one percent (0.1%) for each month the pipe has been in use. For example, if the published material yield point for a pipe material is 35,000 psi, after five years of usage the age adjusted material yield point would be:

$$(35{,}000)(1.00-0.06)=32{,}900 \text{ psi.} \qquad \text{Eq. 3}$$

Figure 8:
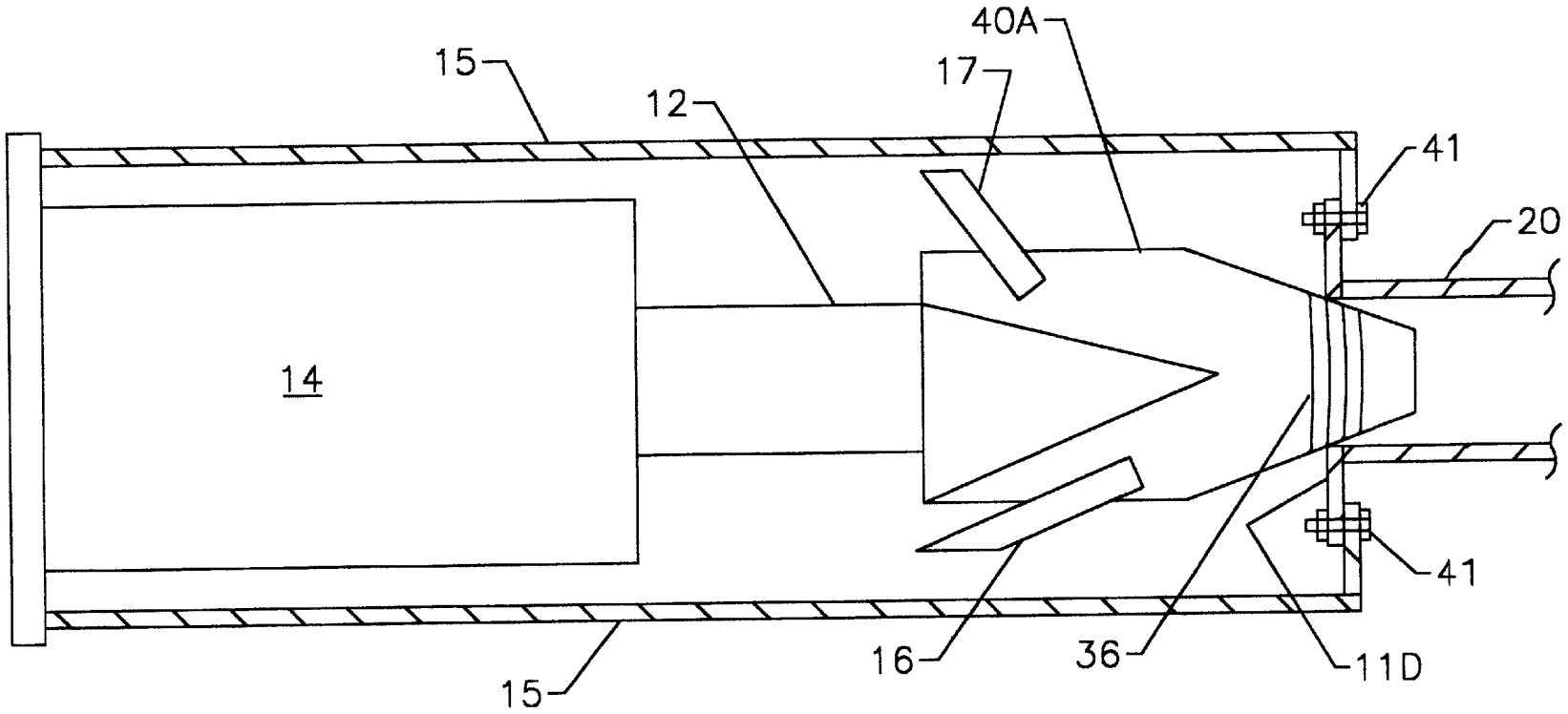
FIG. 8 shows another system for launching the pig into the pipe to be cleaned.

A second system for launching the pig into the pipe to be cleaned is shown in FIG. 8. This system comprises an hydraulic ram 14, and a hydraulic ram shaft 12 extending from hydraulic ram 14 to pig launching head 40A. This launching system may be coupled to the pipe to be cleaned by bracing bracket and support arms 15, which may be bolted to flange 11D at the input to pipe 20 by bolt and nut assemblies 41. Air is supplied through conduit 17 and water is supplied through conduit 16. High pressure o-ring seals 36 may be utilized to provide a fluid seal between the launcher system and flange 11D of the pipe to be cleaned.

It will be appreciated that various modifications and variations may be made to the invention without departing from the scope of the invention as defined in the appended claims. It is the intent to cover within the scope of the appended claims all such modifications and variations.

I claim:

1. A method of cleaning deposits from an interior of a pipe, comprising:

propelling a pig through said pipe with pressure from a fluid mixture comprising at least one liquid and at least one gas applied to said pig from the rear end of said pig;

conducting a portion of said fluid mixture from the rear of said pig to at least one nozzle on the forward end of said pig; and propelling said portion of said fluid through said at least one nozzle to clean said deposits from the interior of said pipe.

2. The method of claim 1 wherein said liquid is water and said gas is air.

3. The method of claim 1 wherein said portion of said fluid mixture is conducted through a conduit from the rear end of said pig to said at least one nozzle.

4. The method of claim 1 wherein said portion of said fluid mixture is conducted to and propelled through a plurality of nozzles on the forward end of said pig.

5. The method of claim 1 wherein said fluid mixture is injected into said pipe at a pressure of at least 1000 pounds per square inch.

6. A method for cleaning deposits from an inside wall of a pipe, comprising:

propelling a pig through said pipe with pressure applied to said pig by a fluid mixture injected into said pipe, said fluid mixture comprising at least one liquid and at least one gas, and cleaning deposits from said inside wall of said pipe by simultaneously propelling a portion of said fluid mixture through at least one nozzle mounted on said pig with sufficient force to clean said deposits from the inside wall of said pipe by blasting and by propelling said fluid mixture through said pipe with sufficient velocity to clean said pipe by the generation of vibrations of different frequencies in said pipe and is said deposits.

7. A method of cleaning deposits from an interior of a pipe with a pig, comprising:

applying a force to the rear end of said pig by means of a fluid mixture injected into said pipe by a pig launcher, said fluid mixture comprising a liquid and a gas;

propelling a portion of said fluid mixture through a nozzle on the forward end of said pig;

wherein said force generates a pressure in said pipe of about $$(2t)(myp)/0.75(o.d.)$$

where:

t=pipe wall thickness, myp=the yield point of the pipe material in new condition reduced by 0.1 percent per month for each month the pipe has been in use, and o.d.=outside diameter of the pipe.

8. The method of claim 7 wherein said fluid mixture comprises water and air.

* * * * *